US006647695B2

(12) United States Patent
Weder

(10) Patent No.: US 6,647,695 B2
(45) Date of Patent: Nov. 18, 2003

(54) COVER FORMING METHOD WITH DOWNWARD PIVOTING FORMING MEMBERS

(75) Inventor: Donald E. Weder, Highland, IL (US)

(73) Assignee: Southpac Trust International, Inc., Highland, IL (US)

( * ) Notice: Subject to any disclaimer, the term of this patent is extended or adjusted under 35 U.S.C. 154(b) by 78 days.

(21) Appl. No.: 09/981,022

(22) Filed: Oct. 16, 2001

(65) Prior Publication Data

US 2003/0110734 A1 Jun. 19, 2003

(51) Int. Cl.[7] ..... B65B 25/02

(52) U.S. Cl. ..... 53/397; 53/464; 53/221; 53/592

(58) Field of Search ..... 53/397, 416, 464, 53/209, 218, 219, 220, 221, 222, 390, 248, 261, 262, 592; 206/423; 47/72

(56) References Cited

U.S. PATENT DOCUMENTS

| | | | | |
|---|---|---|---|---|
| 2,265,636 A | * | 12/1941 | Eaton | 53/222 |
| 2,656,659 A | * | 10/1953 | Buechek | 53/221 |
| 2,971,312 A | * | 2/1961 | Bell, Jr. | 53/390 |
| 4,733,521 A | | 3/1988 | Weder et al. | |
| 5,105,599 A | | 4/1992 | Weder | |
| 5,291,721 A | | 3/1994 | Weder et al. | |
| 5,450,707 A | | 9/1995 | Weder et al. | |
| 5,611,192 A | | 3/1997 | Weder | |
| 5,615,534 A | | 4/1997 | Weder | |
| 5,661,952 A | | 9/1997 | Weder et al. | |
| 5,752,360 A | | 5/1998 | Weder | |
| 5,820,712 A | | 10/1998 | Weder et al. | |
| 5,839,256 A | | 11/1998 | Weder et al. | |
| 5,985,380 A | | 11/1999 | Weder | |
| 6,151,865 A | | 11/2000 | Weder | |

FOREIGN PATENT DOCUMENTS

| | | |
|---|---|---|
| EP | 0582853 | 2/1994 |

* cited by examiner

*Primary Examiner*—Stephen F. Gerrity
(74) *Attorney, Agent, or Firm*—Dunlap, Codding & Rogers P.C.

(57) ABSTRACT

The present invention is directed to an apparatus and method for covering a flower pot with a sheet of material. The apparatus includes a supporting platform, a pot receiving opening formed through the supporting platform and a plurality of forming members radially arranged around the pot receiving opening. The plurality of forming members are designed and disposed such that upon insertion of the flower pot and the sheet of material into the pot receiving opening the forming members pivot in a downward direction and form the sheet of material around an outer peripheral surface of the flower pot. The forming members are also upwardly biased so as to assist in ejecting the covered flower pot in an upward direction from the pot receiving opening.

4 Claims, 7 Drawing Sheets

COVER FORMING METHOD WITH DOWNWARD PIVOTING FORMING MEMBERS

CROSS REFERENCE TO RELATED APPLICATIONS

Not Applicable.

FIELD OF THE INVENTION

The present invention generally relates to a cover forming apparatus for forming a sheet of material about an object to produce a cover for the object, and more particularly, but not by way of limitation, to a cover forming apparatus for forming a decorative cover for a flower pot.

DETAILED DESCRIPTION OF THE INVENTION

Figure 1:
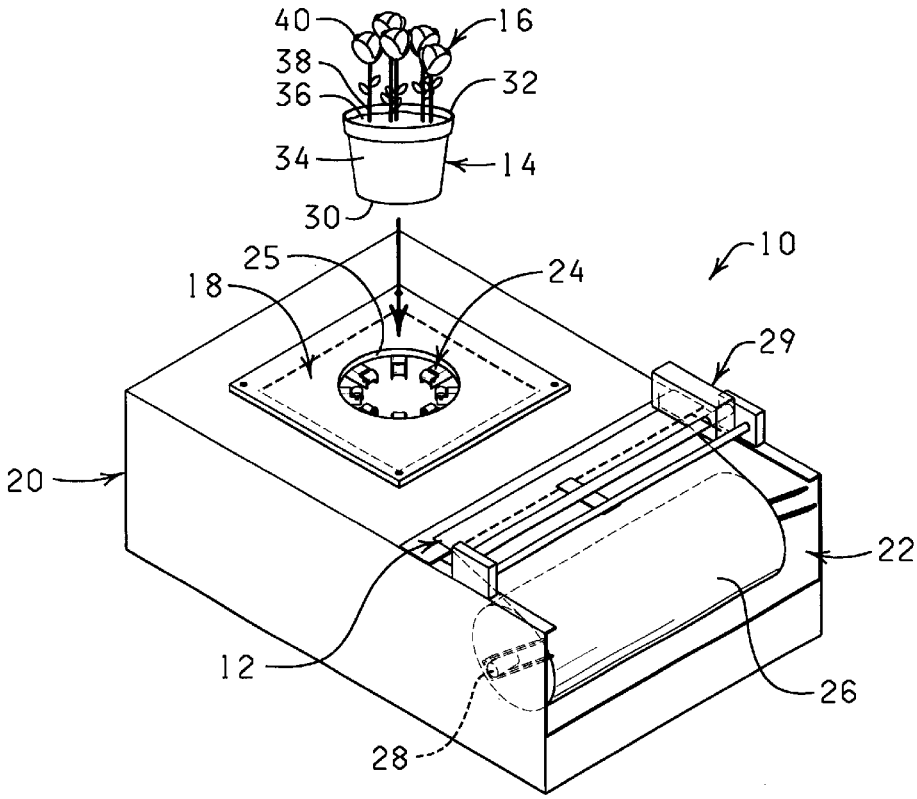
FIG. 1 is a perspective view of a cover forming apparatus constructed in accordance with the present invention.
Figure 14:
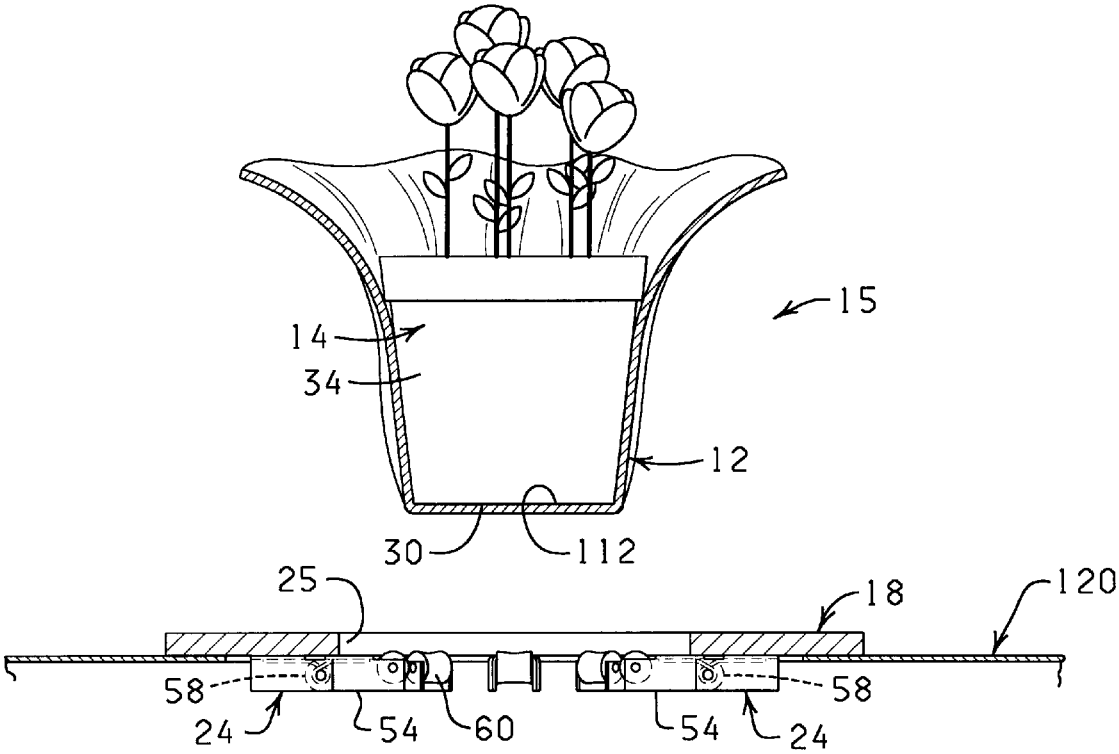
FIG. 14 is an elevational view, partially in cross-section, of the cover forming apparatus of FIG. 1 depicting a flower pot having a decorative cover formed thereabout removed from the pot receiving opening in the support platform of the cover forming apparatus.

Referring now to FIG. 1, shown therein and designated by reference numeral 10 is a cover forming apparatus for dispensing a sheet of material 12 (FIGS. 5, 7–13) and wrapping the sheet of material 12 about a flower pot 14 to form a decorative cover 15 about the flower pot 14 (FIG. 14) in accordance with the present invention. The flower pot 14 containing a floral grouping 16 is shown positioned above the cover forming apparatus 10. The cover forming apparatus 10 includes a support platform 18, a housing 20 having a material holding chamber 22 and a plurality of forming members 24 connected to the support platform 18 so as to be disposed about a pot receiving opening 25 in the support platform 18. A roll of material 26 is rotatably supported within the material holding chamber 22, via an axle 28, and the cover forming apparatus 10 further includes a cutting assembly 29 for separating sheets of material 12 from the roll of material 26. The forming members 24 are pivotable in a downward direction such that the forming members 24 cooperate to form the sheet of material 12 into the decorative cover 15 about the flower pot 14 when the sheet of material 12 and the flower pot 14 are moved into the pot receiving opening 25 in the support platform 18; and the forming members 24 are biased in an upward direction such that the forming members 24 assist in removing the flower pot 14 with the decorative cover 15 formed thereabout from the pot receiving opening 25 of the support platform 18.

The flower pot 14 has a substantially closed lower end 30, an open upper end 32, an outer peripheral surface 34 and a floral grouping retaining space 36 formed generally between the closed lower end 30 and the open upper end 32. The flower pot 14 is adapted to receive portions of the floral grouping 16 within the floral grouping retaining space 36 and to support the floral grouping 16 with a portion of the floral grouping 16 extending generally outwardly from the open upper end 32 of the flower pot 14. Examples of pots which can be used as the flower pot 14 in accordance with the present invention include clay pots, wooden pots, plastic pots, metal pots, ceramic pots and the like.

The floral grouping 16 generally has a lower end portion 38 comprising mostly the stem portion of the floral grouping 16 and an upper end portion 40 comprising the flower end of the floral grouping 16. The lower end portion 38 of the floral grouping 16 is disposed in the flower pot 14 and the flower pot 14, together with the contents of the flower pot 14 such as soil, growing medium or other support elements, cooperate to support the floral grouping 16 in an upright position with the upper end portion 40 of the floral grouping 16 extending outwardly from the open upper end 32 of the flower pot 14 and extending a distance generally above the open upper end 32 of the flower pot 14.

The term "floral grouping" as used in this context means a potted plant or flower, although a flower pot could be utilized to hold cut fresh flowers or cut plants or artificial flowers if one so desired.

Figure 2:
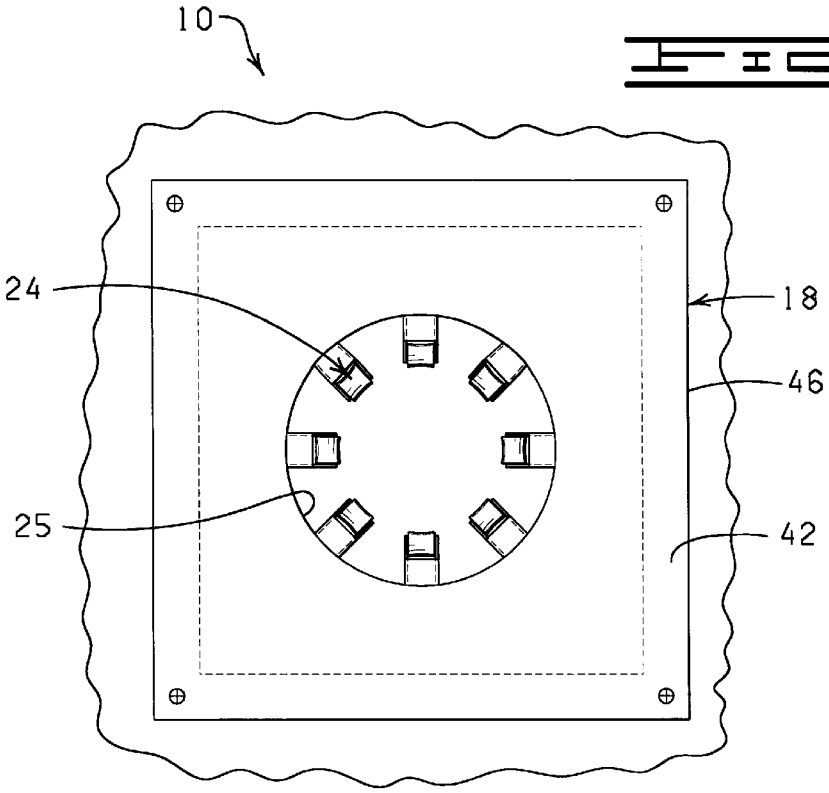
FIG. 2 is a top plan view of a supporting platform of the cover forming apparatus of FIG. 1.
Figure 4:
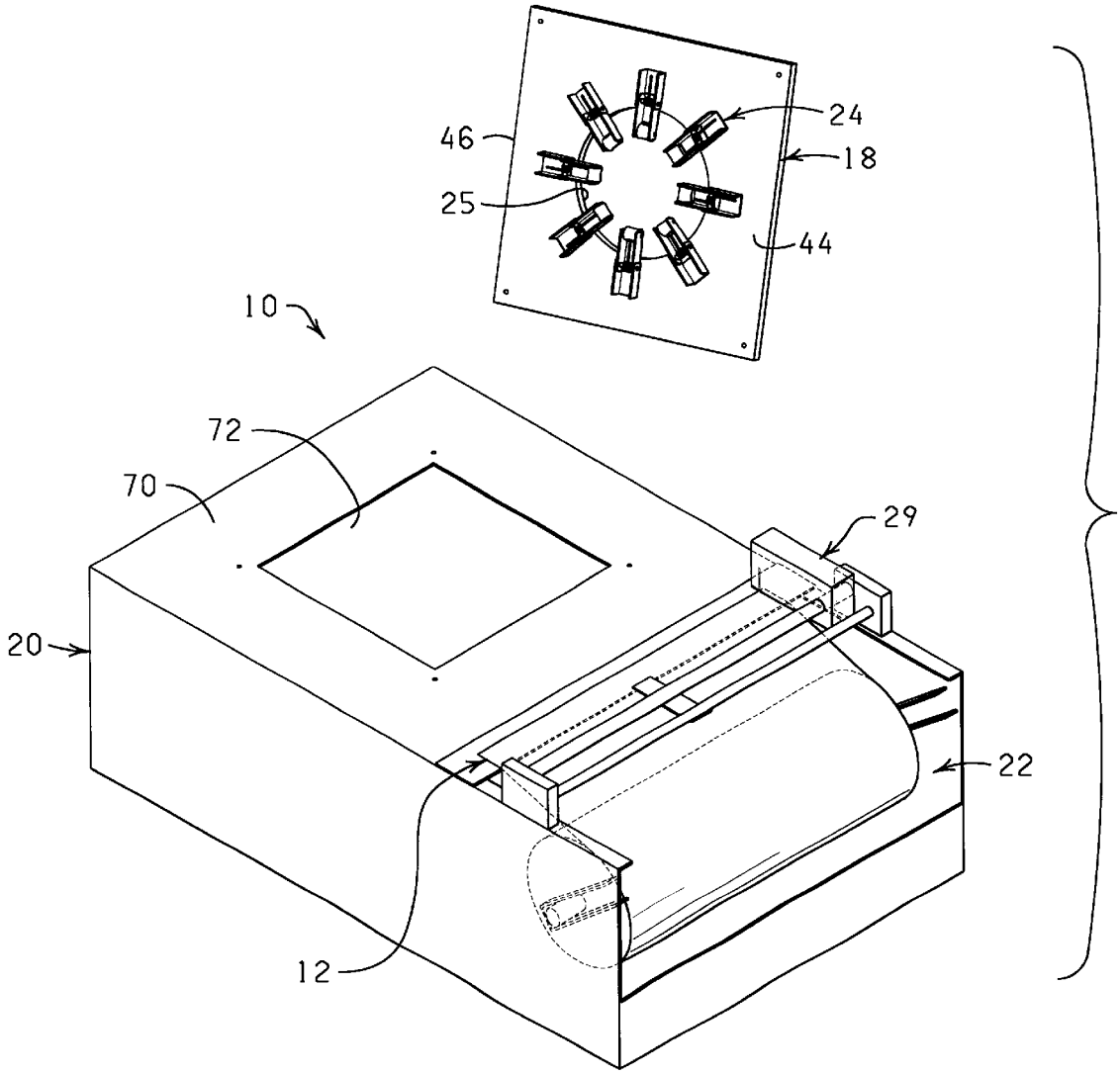
FIG. 4 is a partial exploded, perspective view of the cover forming apparatus of FIG. 1.

Referring now to FIGS. 2 and 4, the support platform 18, which is sized to receive and support the sheets of material 12, has an upper surface 42, a lower surface 44 (FIG. 4), an outer perimeter 46, and the pot receiving opening 25 formed through the upper and lower surfaces 42 and 44 of the support platform 18. The location of the pot receiving opening 25 can vary, however, for most applications the pot receiving opening 25 will be substantially centrally located in the support platform 18, as shown. The pot receiving opening 25 is sized and shaped such that at least a lower portion, but not all, of the flower pot 14 can be disposed through the pot receiving opening 25. An elastomeric ring (not shown) or the like may be provided around the perimeter of the pot receiving opening 25 to protect the sheet of material 12 from damage as the sheet of material 12 is pushed through the pot receiving opening 25 during formation of the decorative cover 15 about the flower pot 14. The support platform 18 can be constructed out of any material suitable for supporting the sheet of material 12, and through which the pot receiving opening 25 can be formed and to which the plurality of forming members 24 can be attached.

The forming members 24 are arranged around the pot receiving opening 25 of the support platform 18. Each of the forming members 24 is connected to the support platform 18 so as to extend into the pot receiving opening 25. The forming members 24 are selectively pivotable in a downward direction such that the forming members 24 cooperate to form the sheet of material 12 into the decorative cover 15 about the flower pot 14 when the sheet of material 12 and the flower pot 14 are moved into the pot receiving opening 25 in the support platform 18. The pivoting members 54 are biased in an upward direction, by a spring 58 (FIGS. 3, 12, 13 and 14) to assist in removing the flower pot 14 having the decorative cover 15 formed thereabout from the pot receiving opening 25 and to substantially prevent the decorative cover 15 from being torn or otherwise damaged during removal of the flower pot 14 and decorative cover 15 from the pot receiving opening 25.

Figure 3:
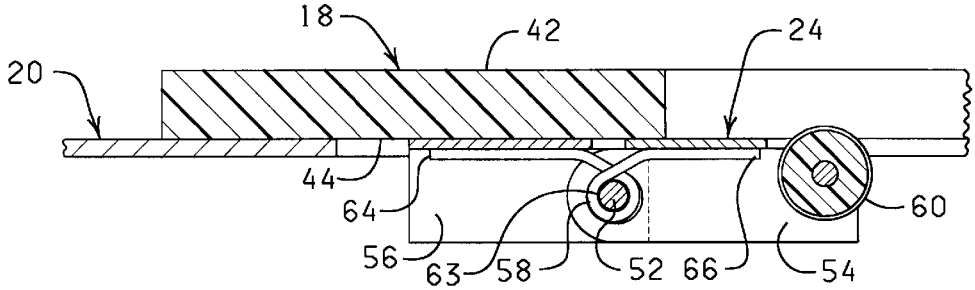
FIG. 3 is an elevational view, partially in cross-section, of the supporting platform of FIG. 2 showing one forming member.

Referring now to FIG. 3, shown therein in more detail is one of the plurality of forming members 24. The forming member 24 includes a pivot pin 52 about which the pivoting member 54 pivots, a stationary member 56 connected to the support platform 18, the spring 58 and a roller 60.

The stationary member 56 of the forming member 24 is shown as connected to the lower surface 44 of the support platform 18. However, the stationary member 56 can be connected to or recessed into the upper or lower surfaces 42 and 44 of the support platform 18. The forming member 24 is oriented in a direction such that the pivot pin 52 and the pivoting member 54 extend into the pot receiving opening 25 (FIGS. 1 and 2) in a general direction toward the center of the pot receiving opening 25.

The spring 58 has a central portion defining a pivot pin opening 63, a first leg 64 and a second leg 66. The pivot pin 52 is disposed in the pivot pin opening 63 of the spring 58 such that the first leg 64 of the spring 58 is in contact with the stationary member 56 of the forming member 24 and the second leg 66 of the spring 58 is in contact with the pivoting member 54 of the forming member 24. Thus, the pivoting member 54 can be pivoted downward and the spring 58 biases the pivoting member 54 in an upward position when there is no downward force being applied to the pivoting member 54. The roller 60 is rotatably connected to the pivoting member 54. The roller 60 contacts the sheet of material 12 and forces the sheet of material 12 against the outer peripheral surface 34 of the flower pot 14 as the flower pot 14 is moved into the pot receiving opening 25.

Referring again to FIG. 4, shown therein in the support platform 18 and the housing 20. The housing 20 can be of any design and can be constructed out of any material so long as the housing 20 is of sufficient structural integrity to support the support platform 18, the forming members 24, the sheet of material 12 and, also accommodate the pot receiving opening 25. By way of example, the housing 20 could be in the configuration of a metal or wooden table having four legs, a tripod having three legs or even a box. Regardless of the configuration of the housing 20, the housing 20 has an upper support surface 70 upon which the lower surface 44 of the support platform 18 rests and a cavity 72 aligned with and positioned below the pot receiving opening 25 in the support platform 18. The cavity 72 is configured and dimensioned such that the flower pot 14 can be at least partially inserted into the pot receiving opening 25 in the support platform 18 and into the cavity 72 of the housing 20. The support platform 18 is preferably removably connected to the housing 20 to allow different sized support platforms 18 with different sized pot receiving openings 25 to be attached to the housing 20. The support platform 18 can be removably connected to the housing 20 by a variety of attaching elements such as, nuts and bolts, screws, bonding materials, magnets, or hook and loop material or any combination or derivation thereof. Although the cover forming apparatus 10 is shown as having the support platform 18 removably connected to the housing 20, those skilled in the art would readily recognize that the cover forming apparatus 10 could also be configured such that the support platform 18 and the housing 20 are of unitary construction.

Figure 5:
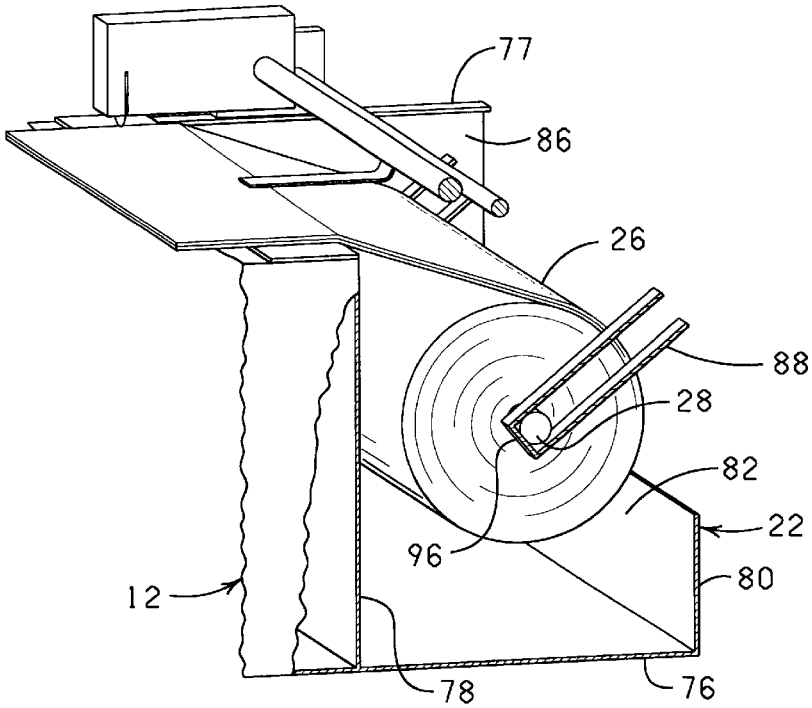
FIG. 5 is a fragmental perspective view of a material holding chamber holding a roll of material of the cover forming apparatus of the present invention.
Figure 6:
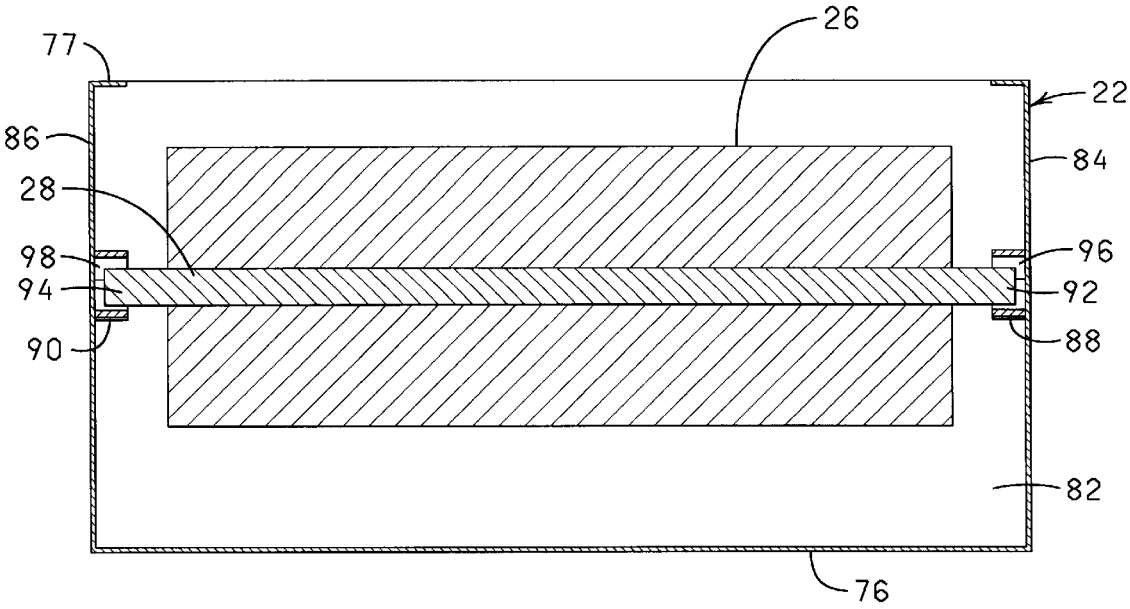
FIG. 6 is a cross-sectional view of the material holding chamber of FIG. 5.

Referring now to FIGS. 5 and 6, in combination with FIGS. 1 and 4, shown therein is the material holding chamber 22 of the housing 20. The material holding chamber 22 provides a convenient apparatus for storing the roll of material 26 and dispensing material therefrom. The material holding chamber 22 has a bottom 76, a substantially open upper end 77, a front side 78, a back side 80, and a roll retaining cavity 82. The material holding chamber 22 also has a first end 84 and a second end 86 cooperating with the front and back sides 78 and 80 and the bottom 76 and the substantially open upper end 77 to substantially define the roll retaining cavity 82.

As best shown in FIG. 6, each of the first and second ends 84 and 86 of the material holding chamber 22 include a first and a second ledge 88 and 90, respectively, extending from the respective first and second end 84 and 86 into the roll retaining cavity 82. The first and second ledges 88 and 90 cooperate to rolling support a first end 92 and a second end 94 of the axle 28 which is disposed through a central passageway in the roll of material 26. The axle 28 is constructed of material of sufficient structural integrity to support the weight of the roll of material 26. The first end and second end 92 and 94 of the axle 28 extend past the roll of material 26 so as to provide cylindrical surfaces upon which to rollingly support the roll of material 26. The first and second ledges 88 and 90 are sized such that when the roll of material 26 and the axle 28 are disposed into the roll retaining cavity 82, the first and second ledges 88 and 90 provide support for the axle 28 and the roll of material 26 near the first and second ends 92 and 94 of the axle 28, while preventing the first and second ledges 88 and 90 from coming into contact with the roll of material 26. Connected to the first ledge 88 and the first end 84 of the material holding chamber 22 is a first back stop 96, and connected to the second ledge 90 and the second end 86 of the material holding chamber 22 is a second back stop 98. The first and second back stops 96 and 98 are substantially the same width as the first and second ledges 88 and 90 to which the first and second back stops 96 and 98 are connected. Each first and second back stop 96 and 98 extends into the roll retaining cavity 82 and are attached to the first and second ledges 88 and 90 so as to prevent the axle 28 from rolling off the first and second ledges 88 and 90 when roll of material 26 and the axle 28 are disposed within the roll retaining cavity 82 of the material holding chamber 22.

Figure 11:
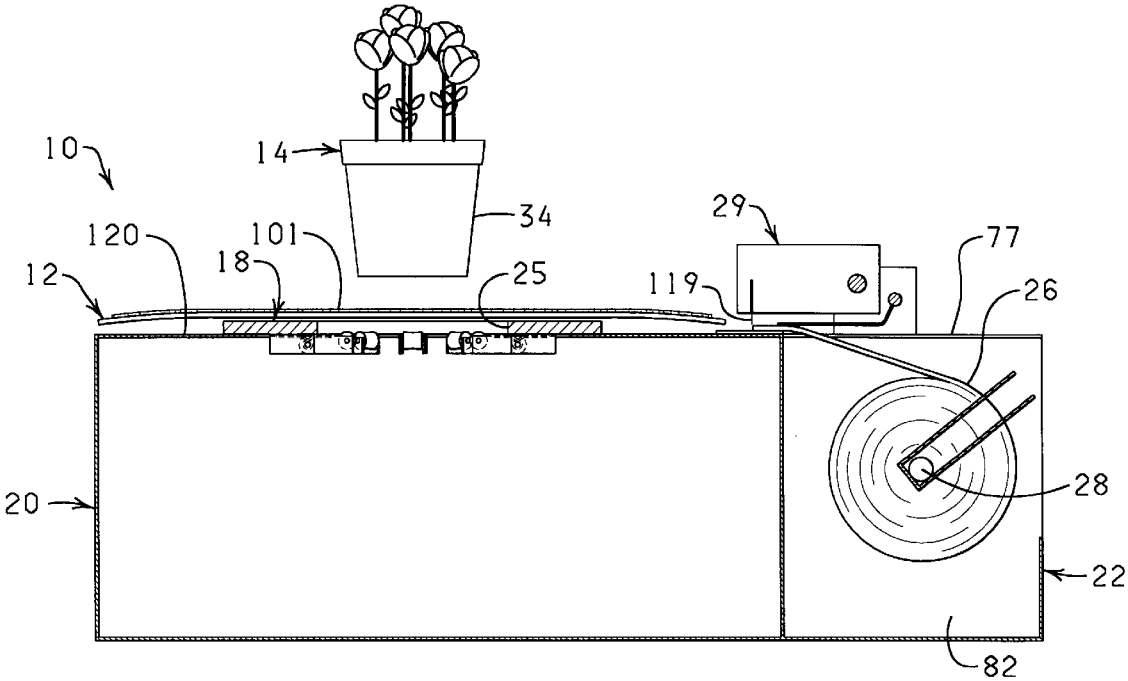
FIG. 11 is a cross-sectional view of the cover forming apparatus of FIG. 1 having a slidable cutting assembly.
Figure 12:
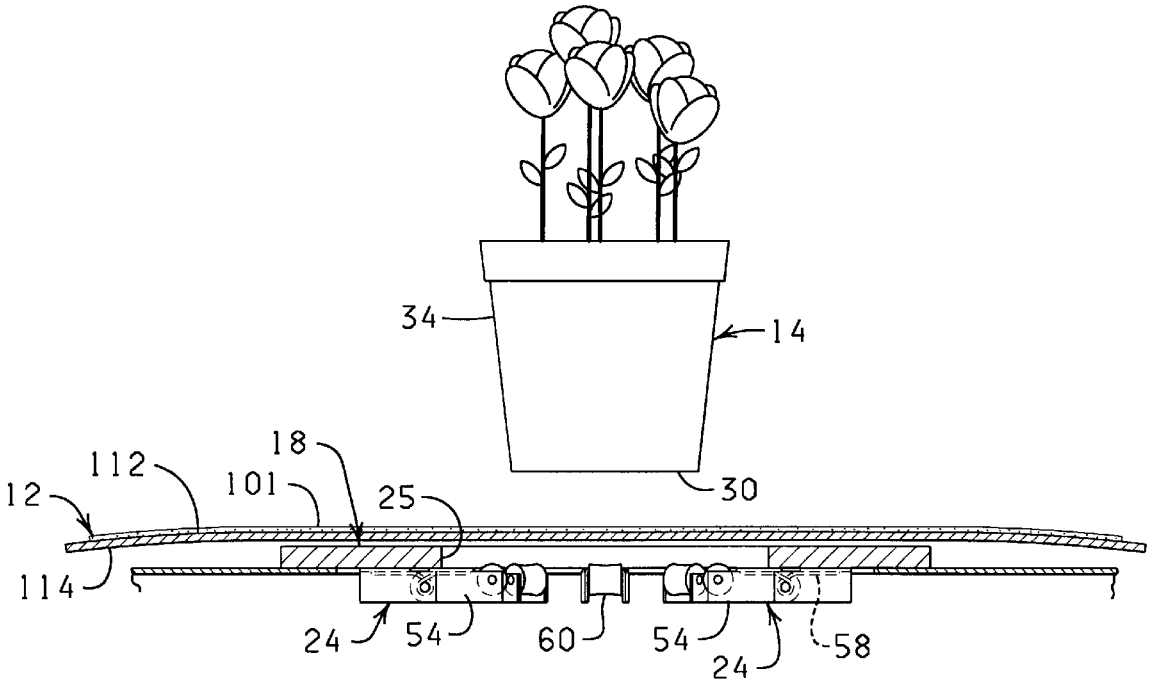
FIG. 12 is an elevational view, partially in cross-section, of the cover forming apparatus of FIG. 1 with a flower pot and a sheet of material disposed above a pot receiving opening in the support platform of the cover forming apparatus.
Figure 13:
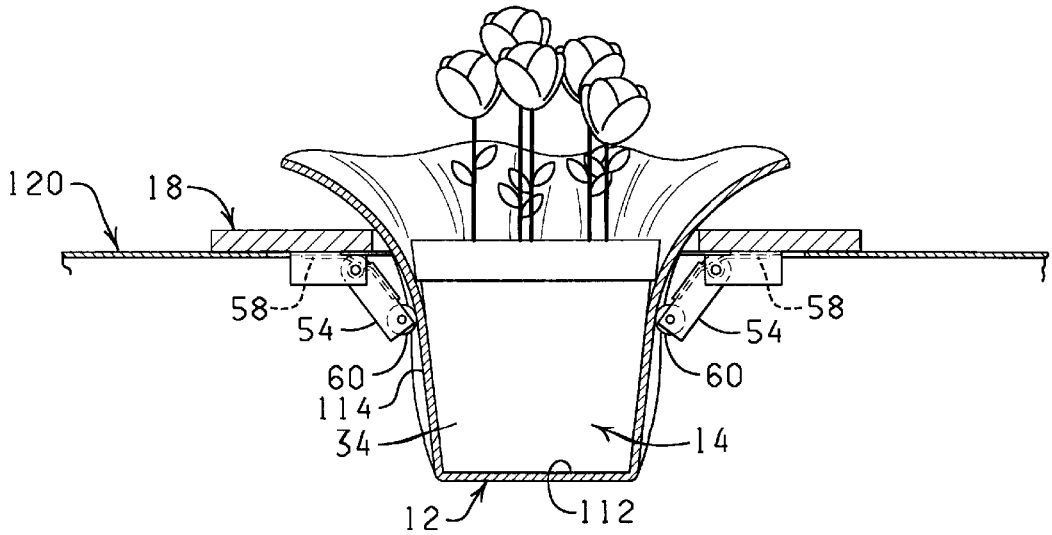
FIG. 13 is an elevational view, partially in cross-section, of the cover forming apparatus of FIG. 1 illustrating a sheet of material being formed about a flower pot disposed within the pot receiving opening in the support platform of the cover forming apparatus.

The roll of material 26 and the axle 28 are disposed in the roll retaining cavity 82 of the material holding chamber 22 and are aligned with the support platform 18 such that as the material is dispensed from the roll of material 26, the material is disposed onto the support platform 18 and over the pot receiving opening 25 substantially as shown in FIGS. 11 and 12.

Figure 7:
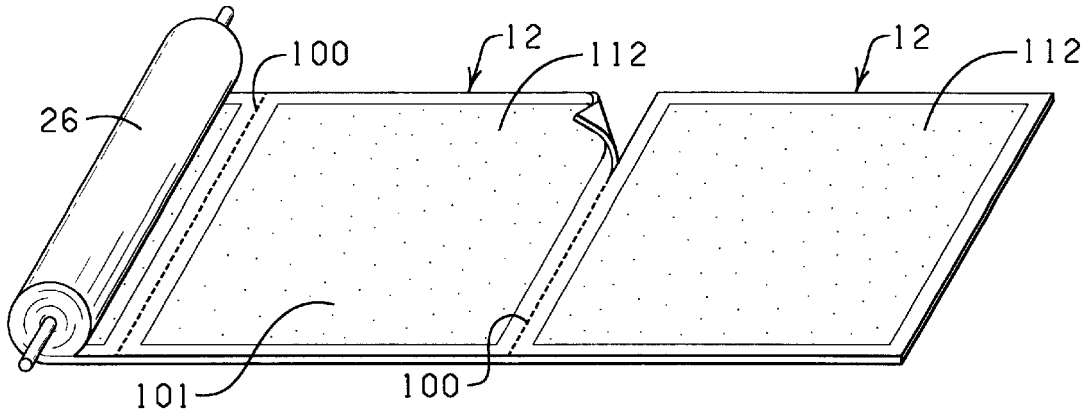
FIG. 7 is a perspective view of a roll of material from which a sheet of material may be obtained, one corner of one of the sheets of material being upwardly turned and partially detached from an adjacent sheet of material.
Figure 9:
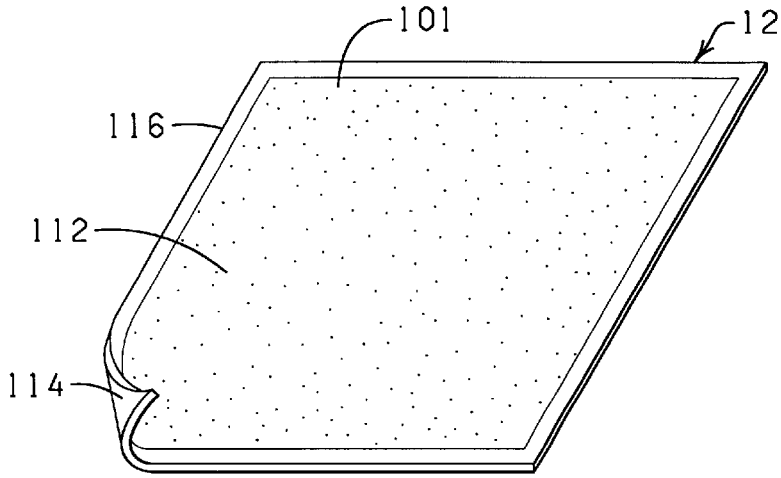
FIG. 9 is a perspective view of a sheet of material utilized to form a decorative cover about a flower pot in accordance with the present invention, one corner of the sheet of material upwardly turned.
Figure 10:
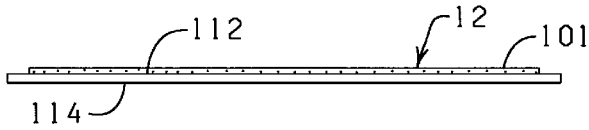
FIG. 10 is an elevational view of the sheet of material shown in FIG. 9.
Figure 10A:
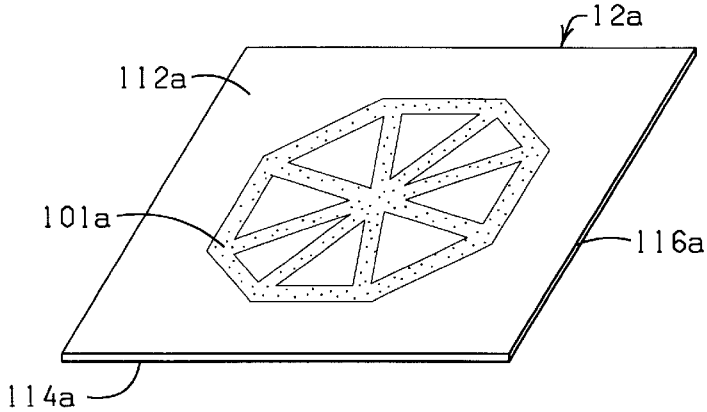
FIG. 10A is a perspective view of another embodiment of a sheet of material utilized to form a decorative cover about a flower pot in accordance with the present invention.

Referring now to FIG. 7, shown therein is the roll of material 26 from what the sheets of material 12 are produced. The roll of material 26 includes a pressure sensitive adhesive 101 thereon and can also include detaching elements 100 for separating the roll of material 26 into a plurality of sheets of material 12. The pressure sensitive adhesive 101 can be disposed so as to substantially cover the upper surface 112 (FIG. 10) of the sheet of material 12 as shown in FIGS. 7, 9 and 10 or a pressure sensitive adhesive 101*a* can be disposed on only preselected portions of a sheet of material 12*a* as shown in FIG. 10*a*. The sheet of material 12 or 12A provided from the roll of material 26 is then placed on the support platform 18 to be formed into the decorative cover 15 for the flower pot 14 as will be described in more detail later.

Figure 8:
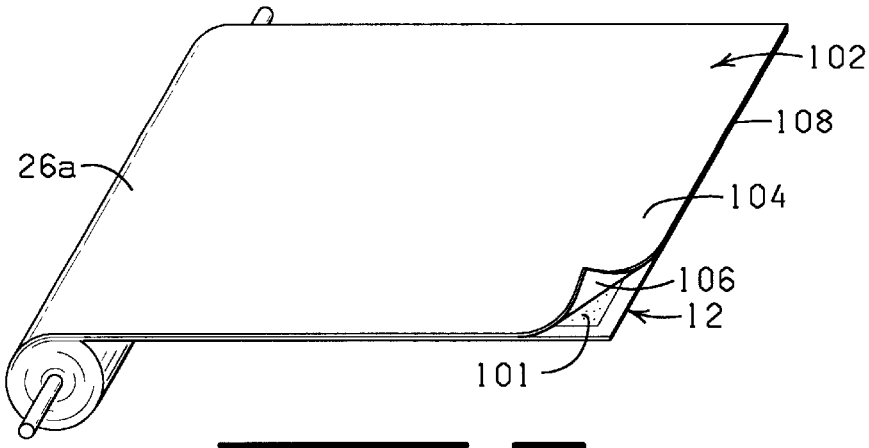
FIG. 8 is a perspective view of the roll of material of FIG. 7 with release sheets disposed over a pressure sensitive adhesive on the roll of material.

Referring now to FIG. 8, shown therein is another roll of material 26*a* similar to the roll of material 26 except the roll of material 26*a* further includes a layer of release sheets 102. The layer of release sheets 102 has an upper surface 104, a lower surface 106, and an outer periphery 108. It will be appreciated that the layer of release sheets 102 substantially covers the pressure sensitive adhesive 101 disposed on the material. The layer of release sheets 102 is removably disposed over the pressure sensitive adhesive 101 to prevent the pressure sensitive adhesive 101 from bonding together overlaying material in the roll of material 26*a* and to protect the adhesion qualities of the pressure sensitive adhesive 101. When material is detached or severed from the roll of material 26*a*, the layer of release sheet 102 is simultaneously also detached or severed from the roll of material 26*a*. The layer of release sheets 102 is removed from the sheet of material 12 either before or after positioning the sheet of material 12 on the support platform 18 of the cover forming apparatus 10.

Referring now to FIGS. 9 and 10, illustrated therein in more detail is the sheet of material 12 provided from the roll of material 26. The sheet of material 12 includes the upper surface 112 having the pressure sensitive adhesive 101 disposed thereon, a lower surface 114 and an outer periphery 116. The sheet of material 12 is generally square or rectangular shaped; however, the sheet of material 12 could be circularly shaped or any other configuration desired in a particular application.

The sheet of material 12 may be constructed from cloth paper, foil, polymeric films or laminates or combinations thereof. The thickness of the sheet of material 12 may vary, depending upon the type of material. The upper limit of the thickness is set such that the material retains sufficient flexibility and fold ability and can easily be shaped by hand about the object to be covered. Typically the sheet of material has a thickness in the range from about 0.01 mil to about 30 mils. In FIG. 10, the pressure sensitive adhesive 101 is applied to substantially the entire upper surface 112 of the sheet of material 12. The thickness of the pressure sensitive adhesive 101 is exaggerated.

Referring now to FIG. 10*a* shown therein is a sheet of material 12*a* which is similar to the sheet of material 12. The sheet of material 12*a* includes an upper surface 112*a*, lower surface 114*a*, an outer periphery 116*a* and an area of pressure sensitive adhesive 101*a*. The only notable difference between the sheet of material 12 and the sheet of material 12*a* is that the pressure sensitive adhesive 101*a* covers only preselected portions of the upper surface 112*a* of the sheet of material 12.

The pressure sensitive adhesive 101 or 101*a* may be any substance, inorganic or organic, natural or synthetic, that is capable of bonding to other surfaces or to other surfaces coated with a like pressure sensitive adhesive. The tack level of the pressure sensitive adhesive 101 and 101*a* should be controlled in most applications so that the sheet of material 12 and 12*a* do not destroy or substantially damage the object bonded thereto when removed from the object or does not destroy any decorative pattern which is applied to the upper and lower surface 112 and 112*a* or 114 and 114*a* of the sheet of material 12 and 12*a* when unbonded. It is also important to control the tackiness of the pressure sensitive adhesive 101 and 101*a* so that the sheets of material 12 and 12*a* will be easily released from a layer of release sheets, such as the layer of release sheets 102 on the sheets of material 12 and 12*a* without destroying or damaging the surface of the sheets of material 12 or 12*a*.

The term "pressure sensitive adhesive" as used herein includes those adhesives mentioned before and it is utilized by the application of a slight pressure such as might be imposed by the forming members 24, for example, as opposed to those adhesives requiring chemical activators or heat to be bondable. Pressure sensitive adhesives and the controlling of the tack level of such pressure sensitive adhesives are well known in the art and a detailed description of such pressure sensitive adhesives is not deemed necessary herein.

Referring now to FIGS. 1 and 11, as previously stated, the cover forming apparatus 10 includes the cutting assembly 29. The cutting assembly 29 is positioned near the material holding chamber 22. The cutting assembly 29 includes a slidable cutting edge 119 which is placed in contact with the material such that as it slides across the material the slidable cutting edge 119 cuts the material and separates the sheet of material 12 from the roll of material 26. Preferably, the cutting assembly 29 is raised so as to ease threading of material between an upper surface 120 of the housing 20 and the cutting assembly 29, and the cutting assembly 29 can be lowered to allow for cutting contact with the material disposed on the upper surface 120 of the housing 20.

Wrapping of the flower pot 14 is best explained with reference to FIGS. 11–14. In operation, an individual grasps the free end of the roll of material 26 and unrolls material from the roll of material 26 upwardly and outwardly through the substantially open upper end 77 (FIGS. 5 and 11) of the material holding chamber 22 until the individual has unrolled a predetermined or desired amount of the material from the roll of material 26. The predetermined or desired amount of material unrolled from the roll of material 26 is generally disposed on the support platform 18 with the cutting assembly 29 disposed above the material and the upper surface 120 of the housing 20. The slidable cutting edge 119 is lowered such that the slidable cutting edge 119 is in contact with the material. The slidable cutting edge 119 is moved across the material unrolled from the roll of material 26. As the slidable cutting edge 119 is moved across the unrolled portion of the roll of material 26 it engages the unrolled portion disposed thereunder, thereby separating the unrolled portion of material from the roll of material 26 and producing the sheet of material 12.

If the sheet of material 12 includes a layer of release sheets 102 disposed over the pressure sensitive adhesive 101 as shown in FIG. 8 when the sheet of material 12 is severed from the roll of material 26, the layer of release sheets 102 is also severed from the roll of material 26. The release sheet 102 is removed from the sheet of material 12 either before or after the sheet of material 12 is positioned on the support platform 18.

The sheet of material 12 is disposed on the support platform on the support platform 18 substantially as shown in FIG. 12. The closed lower end 30 of the flower pot 14 is positioned above the sheet of material 12 and aligned substantially with the pot receiving opening 25. The closed lower end 30 of the flower pot 14 is lowered until it engages the sheet of material 12 and continued movement of the flower pot 14 and the sheet of material 12 in the downward direction causes the flower pot 14 and the sheet of material 12 to be disposed into the pot receiving opening 25, until the flower pot 14 and the sheet of material 12 come to rest in a position similar to that illustrated by FIG. 13. As the flower pot 14 and the sheet of material 12 are lowered into the pot receiving opening 25, the lower surface 114 of the sheet of material 12 comes in contact with the rollers 60 on the pivoting members 54 of the forming members 24. The downward movement of the flower pot 14 through the pot receiving opening 25 causes the pivoting members 54 to pivot in a downward direction and the force exerted by the springs 58 of the forming members 24 causes the rollers 60 to press the upper surface 112 of the sheet of material 12 having the pressure sensitive adhesive 101 thereon into contact with the outer peripheral surface 34 of the flower pot 14 and thereby form and adhere the decorative cover 15 about the flower pot 14. Since the pivoting members 54 are biased in an upward direction, the upwardly biased pivoting members 54 assist in removing the flower pot 14 and the decorative cover 15 formed thereabout from the pot receiving opening 25 and cooperate to substantially prevent the decorative cover 15 from being torn or otherwise damaged during removal of the flower pot 14 and decorative cover 15 from the pot receiving opening 25. Although the wrapping of the flower pot 14 to form the decorative cover 15 about the flower pot 14 is illustrated and described herein utilizing the sheet of material 12, those skilled in the art will understand and recognize that the decorative cover 15 can be formed about the flower pot 15 via the same method utilizing the sheet of material 12A having the pressure sensitive adhesive 101*a* on preselected portions of the sheet of material 12*a*.

Changes may be made in the various parts, elements and assemblies as described herein or in the steps of the methods described herein or in the sequence of steps of the methods described herein without departing from the spirit and scope of the invention as defined in the following claims.

What is claimed:

1. A method of forming a decorative cover about a flower pot, comprising:

providing a support platform having a pot receiving opening formed therethrough and a plurality of forming members arranged radially around the pot receiving opening, the forming members being downwardly pivoting and upwardly biased;

placing a sheet of material on the support platform such that the sheet of material is positioned over the pot receiving opening;

placing the flower pot over the sheet of material and the pot receiving opening;

moving the flower pot and the sheet of material into the pot receiving opening such that the forming members are caused to pivot downwardly and press the sheet of material against an outer peripheral surface of the flower pot so as to form a decorative cover about the flower pot; and removing the flower pot having the decorative cover formed thereabout from the pot receiving opening whereby the upwardly biased forming members cooperate in the removal of the flower pot having the decorative cover formed thereabout from the pot receiving opening.

2. The method of claim 1 wherein the sheet of material includes a pressure sensitive adhesive disposed on a surface of the sheet material, and wherein the forming members press the sheet of material against the outer peripheral surface of the flower pot to cause the pressure sensitive adhesive on the sheet material to adhere to the outer peripheral surface of the flower pot and thereby forming a decorative cover about the flower pot.

3. A method of forming a decorative cover about a flower pot, comprising:

providing a support platform for supporting a sheet of material over a pot receiving opening formed through the support platform;

providing a plurality of forming members arranged radially around the pot receiving opening, the forming members being downwardly pivoting and upwardly bias;

providing a roll of material;

unrolling a portion of material from the roll of material and disposing the unrolled portion of material over the pot receiving opening;

cutting the unrolled portion of material from the roll of material to provide the sheet of material;

placing the flower pot over the sheet of material and the pot receiving opening;

moving the flower pot and the sheet of material into the pot receiving opening such that the forming members pivot downwardly and press the sheet of material against the outer peripheral surface of the flower pot so as to cause the sheet of material to form a decorative cover about the flower pot; and removing the flower pot having the decorative cover formed thereabout from the pot receiving opening whereby the upwardly biased forming members cooperate in the removal of the flower pot having the decorative cover formed thereabout from the pot receiving opening.

4. The method of claim 3 wherein the roll of material includes a pressure sensitive adhesive on the material.

* * * * *